US005327951A

United States Patent [19]

Pickle et al.

[11] Patent Number: 5,327,951

[45] Date of Patent: Jul. 12, 1994

[54] WOODBURNING PICTURE METHOD

[76] Inventors: Clarisse Y. Pickle; Tivis T. Pickle, both of North Fork Manor Apts. 209 B-6 401 Elizabeth St., Saltville, Va. 24370

[21] Appl. No.: 835,312

[22] Filed: Feb. 14, 1992

[51] Int. Cl.[5] ..... B27M 1/00; B31F 1/07

[52] U.S. Cl. ..... 144/358; 40/152.2; 144/329; 219/229

[58] Field of Search ..... 40/152, 152.1, 152.2; 101/27, 31, 401.1; 30/146; 29/89.5; 219/229; 144/329, 330, 358, 361

[56] References Cited

U.S. PATENT DOCUMENTS

| | | | |
|---|---|---|---|
| 201,252 | 3/1878 | King | 144/358 |
| 230,407 | 7/1880 | Devereux | 144/358 |
| 597,373 | 1/1898 | Green | 101/31 X |
| 700,348 | 5/1902 | Lyon | 101/31 |
| 744,852 | 11/1903 | Amstutz | 101/401.1 X |
| 1,363,897 | 12/1920 | Morgans | 219/229 |
| 2,033,897 | 3/1936 | Jenkins et al. | 101/31 |
| 2,345,942 | 4/1944 | Lehman | 144/358 |
| 3,247,047 | 4/1966 | Buckley | 144/358 |
| 3,732,908 | 5/1973 | White | 144/358 |
| 4,064,386 | 12/1977 | Numrich, Jr. | 144/358 |
| 4,113,099 | 9/1978 | Beckerman | 144/358 |
| 4,181,763 | 1/1980 | Shellenberger | 144/329 |

*Primary Examiner*—W. Donald Bray
*Attorney, Agent, or Firm*—E. Michael Combs

[57] ABSTRACT

An artwork assemblage is created by the providing of a base plate, with initially directing a writing instrument about a top surface of the base plate to effect creation of a picture outline imparting outline lines upon the base plate top surface. A woodburning tool is subsequently utilized to impart heated, inscribed lines tracing the picture outline. A paint brush is utilized to impart paint and a covering surface such as varnish and the like to the top surface. A lace framework is secured to a continuous side wall of the base plate, wherein subsequently illumination bulbs are mounted within through-extending bores directed from the top surface to a bottom surface of the base plate, with electrical lines and a battery supply mounted to the bottom surface of the base plate.

1 Claim, 5 Drawing Sheets

WOODBURNING PICTURE METHOD

BACKGROUND OF THE INVENTION

1. Field of the Invention

The field of invention relates to artwork classifications, and more particularly pertains to a new and improved woodburning picture method wherein the same is arranged to effect amusement and entertainment of individuals simultaneously creating artwork upon a base plate for subsequent mounting.

2. Description of the Prior Art

Artwork of various types are utilized in the prior art to create aesthetic and pleasing shapes and forms for entertainment and amusement of individuals. Such artwork is exemplified in U.S. Pat. No. 4,578,131 to Hawkins setting forth a three-dimensional sculptured painting sculptured over a top surface of a base plate to create a three-dimensional effect of layers.

U.S. Pat. No. 4,113,099 to Beckerman sets forth a wood carving kit to carve grooves to create an artwork product.

U.S. Pat. Nos. 4,631,847 to Colin; 3,826,020 to Zutz; and 4,255,873 to Eberle are further examples of multidimensional artwork creations.

As such, it may be appreciated that there continues to be a need for a new and improved woodburning picture method as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of artwork methods now present in the prior art, the present invention provides a woodburning picture method wherein the same is arranged to impart a multi-dimensional picture into a top surface of a base plate. As such, the general purpose of the present invention, which will be described subsequently in greater detail, is to provide a new and improved woodburning picture method which has all the advantages of the prior art artwork methods and none of the disadvantages.

To attain this, the present invention provides an artwork assemblage created by the providing of a base plate, with initially directing a writing instrument about a top surface of the base plate to effect creation of a picture outline imparting outline lines upon the base plate top surface. A woodburning tool is subsequently utilized to impart heated, inscribed lines tracing the picture outline. A paint brush is utilized to impart paint and a covering surface such as varnish and the like to the top surface. A lace framework is secured to a continuous side wall of the base plate, wherein subsequently illumination bulbs are mounted within through-extending bores directed from the top surface to a bottom surface of the base plate, with electrical lines and a battery supply mounted to the bottom surface of the base plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved woodburning picture method which has all the advantages of the prior art artwork methods and none of the disadvantages.

It is another object of the present invention to provide a new and improved woodburning picture method which may be easily and efficiently manufactured and marketed.

It is a further object of the present invention to provide a new and improved woodburning picture method which is of a durable and reliable construction.

An even further object of the present invention is to provide a new and improved woodburning picture method which is susceptible of a low cost of manufacture with regard to both materials and labor, and which accordingly is then susceptible of low prices of sale to the consuming public, thereby making such woodburning picture methods economically available to the buying public.

Still yet another object of the present invention is to provide a new and improved woodburning picture method which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
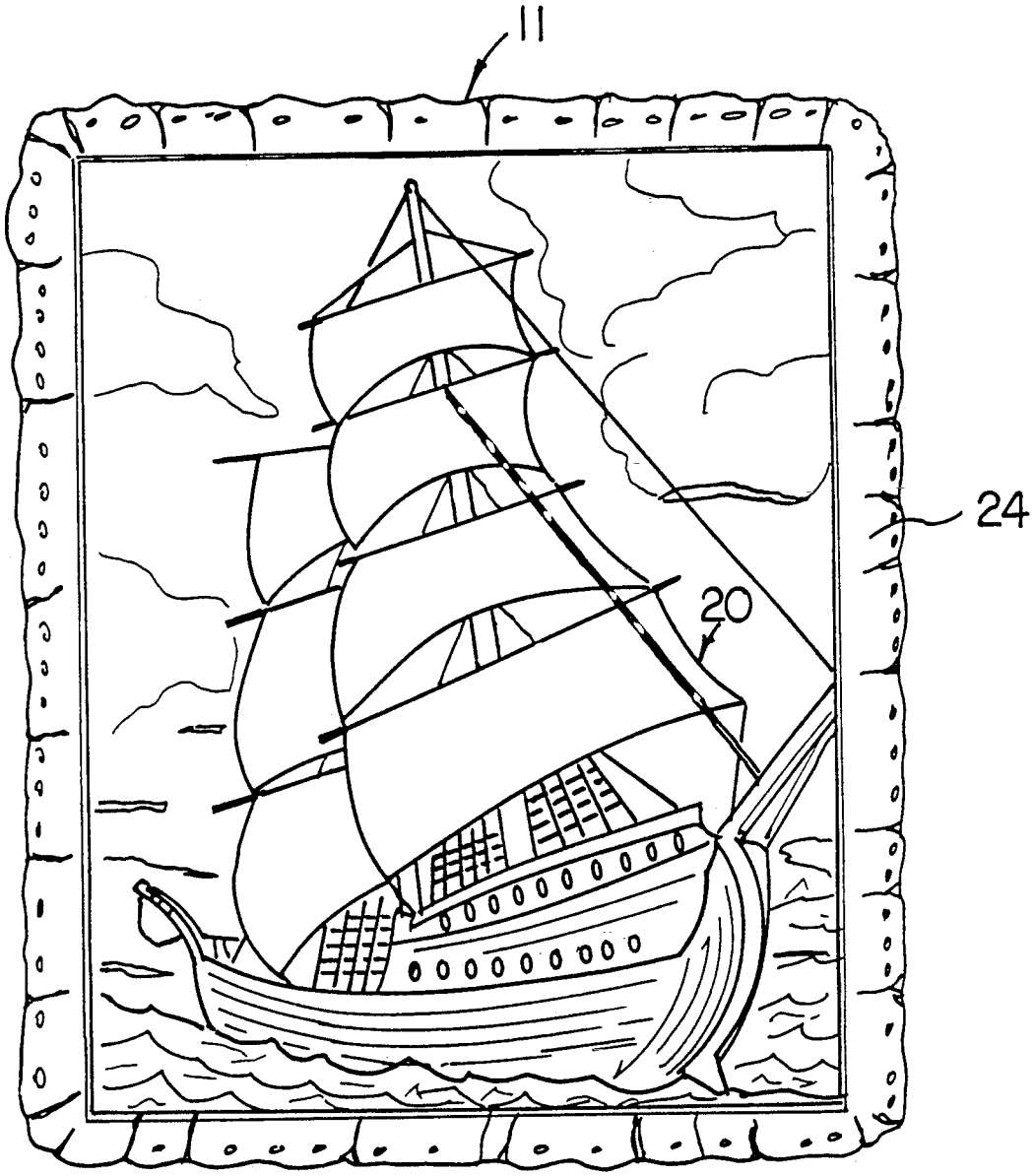
FIG. 1 is an orthographic top view of a completed artwork creation effected by utilization of the method of the invention.

With reference now to the drawings, and in particular to FIGS. 1 to 8 thereof, a new and improved woodburning picture method embodying the principles and concepts of the present invention and generally designated by the reference numeral 11-32 will be described.

More specifically, the woodburning picture method of the invention essentially comprises the creation of a completed artwork assemblage 11, as illustrated in FIG. 1, to include a painted picture within a matrix of burningly inscribed image lines 20 and a lace framework 24 to highlight the centrally oriented artwork picture.

Figure 2:
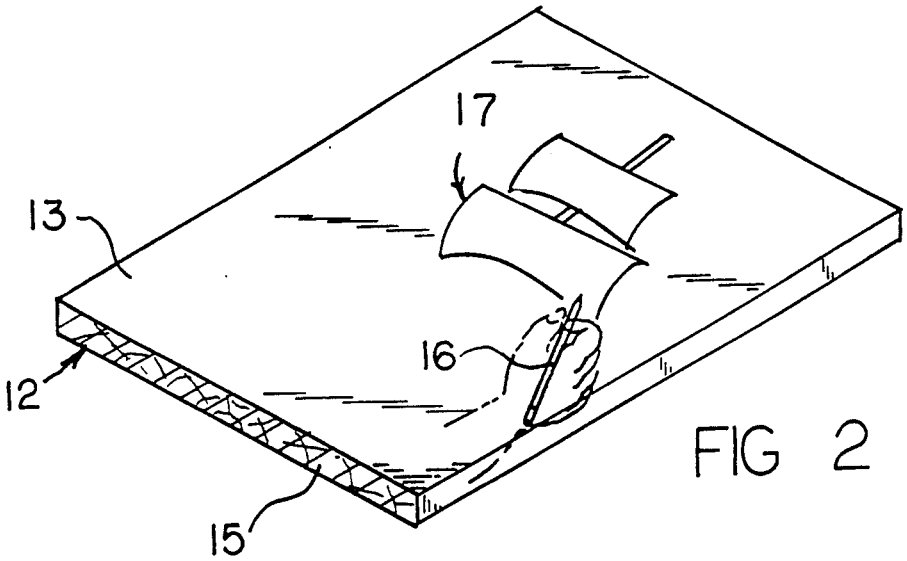
FIG. 2 is an isometric illustration of a first step in imparting an outline onto a top surface of the base plate.
Figure 3:
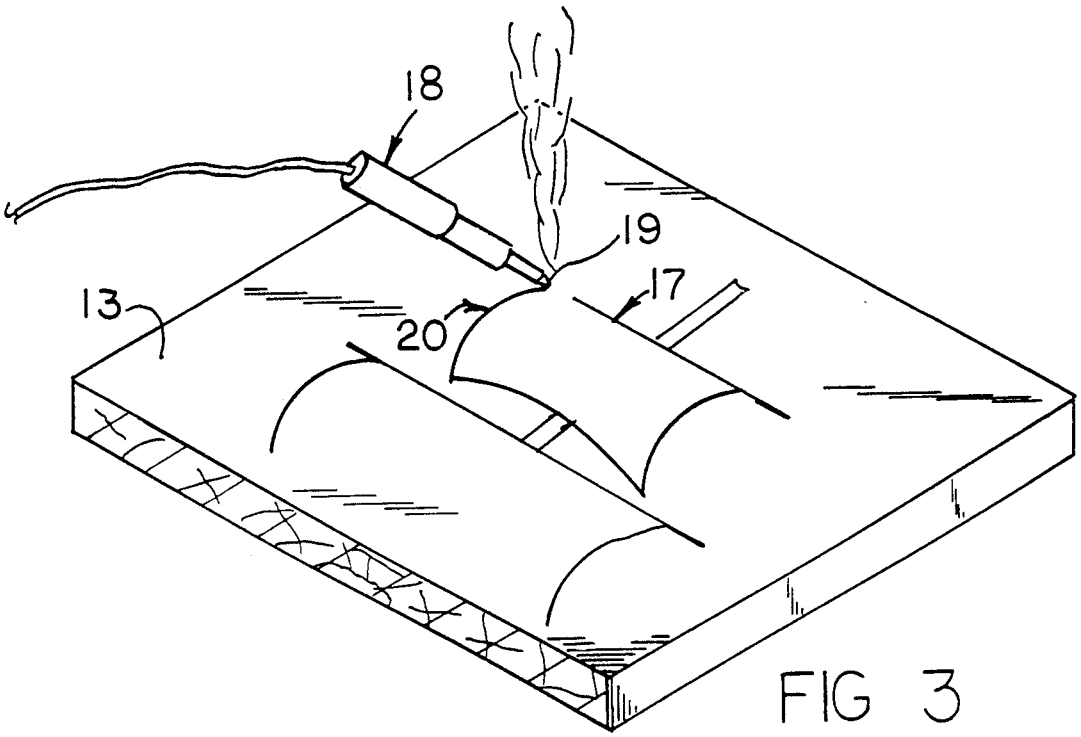
FIG. 3 is an isometric illustration of a second step heating an outline tracing the lines of FIG. 2.
Figure 4:
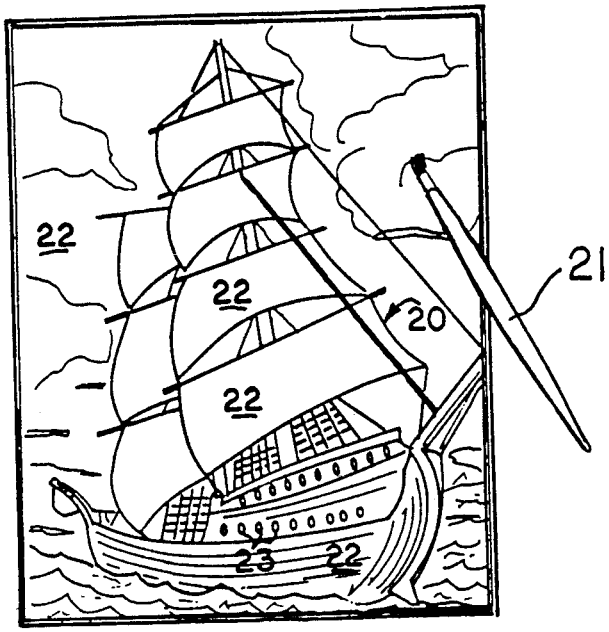
FIG. 4 is an orthographic top view of the invention setting forth the coloration of various portions of a top surface relative to the picture outline.
Figure 5:
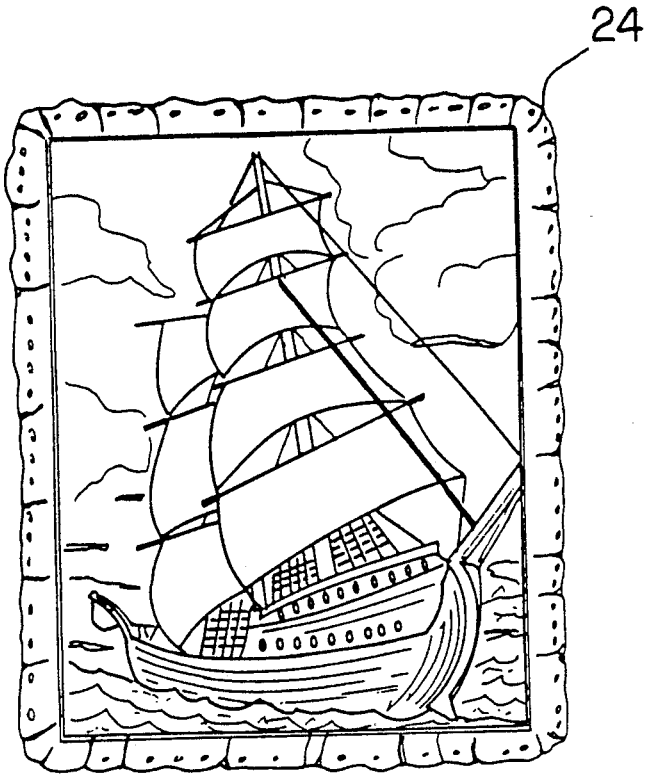
FIG. 5 is a further step imparting a border to a continuous side edge of the base plate.
Figure 6:
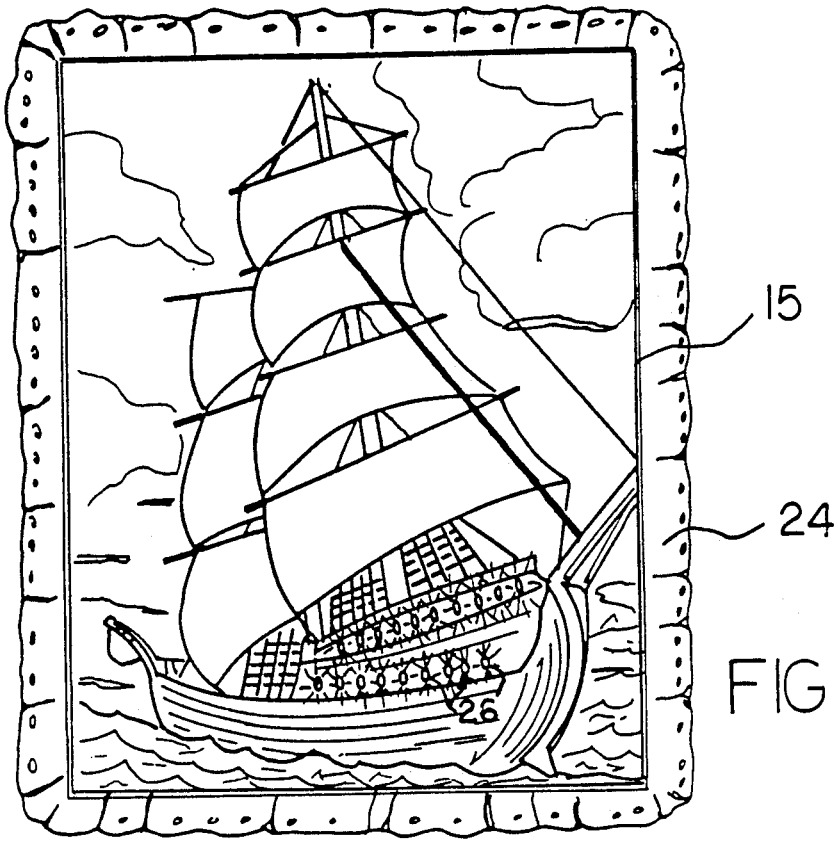
FIG. 6 is an orthographic top view illustrating the positioning of illumination bulbs within the base plate.
Figure 7:
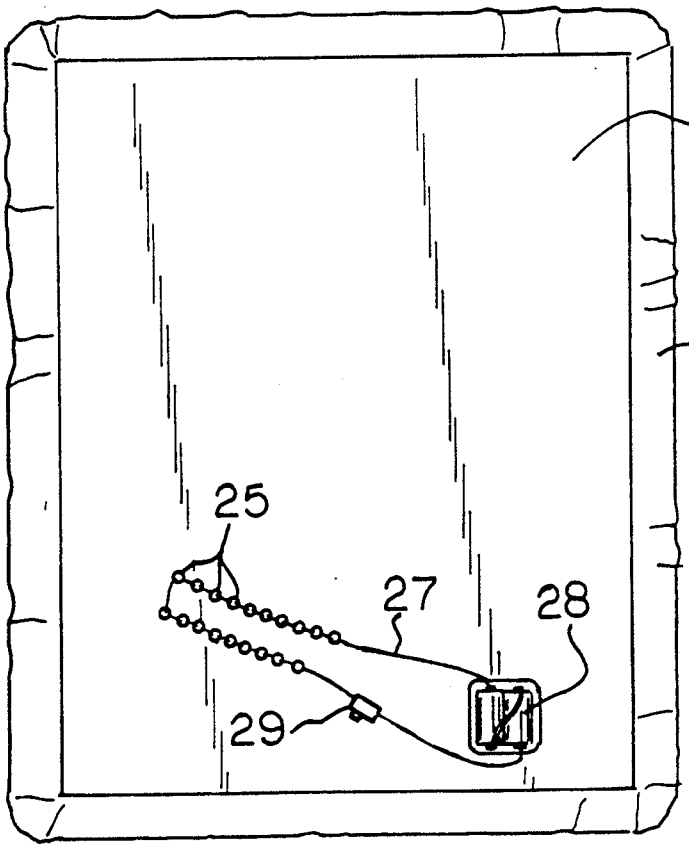
FIG. 7 is an orthographic rear view of the base plate. illustrating the positioning of the batteries and communicating electrical lines.
Figure 8:
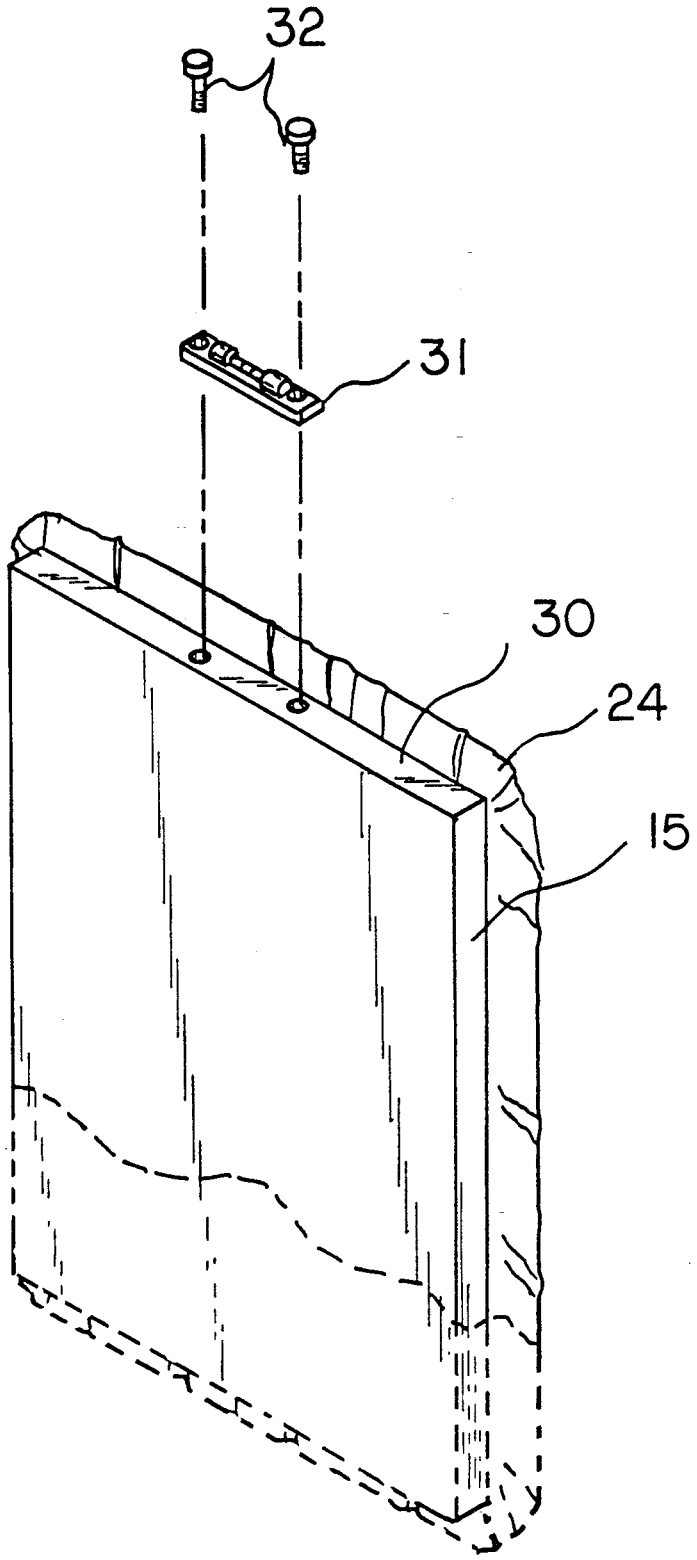
FIG. 8 is an isometric illustration of the invention positioning a leveling device to a top surface of the edge of the base plate.

Reference to FIG. 2 illustrates the provision of a base plate 12 typically formed of a fibrous material such as wood and the like, but wherein other suitable products may be utilized that accommodate the burning of inscribed lines to create an artwork outline. The base plate 12 includes a top surface 13 spaced from a bottom surface 14 (see FIG. 7), with a continuous side wall 15. A writing instrument 16 is utilized to impart a picture outline 17 onto the top surface 13, as illustrated. Subsequently as illustrated in FIG. 3, a woodburning tool 18 formed with a heated tip 19 of sufficient temperature to burn in inscribed lines 20 is utilized, wherein the inscribed lines are traced and are thereby coextensively imparted onto the picture outline 17. A paint brush 21 is utilized utilizing various colorations to paint variously colored panels 22 onto the top surface within the inscribed lines 20. It should be further noted that inscribed portals 23 are formed within the inscribed lines 17. In this manner, communicating bores 25 (see FIG. 7) are directed coextensively through the bottom surface 14 to the top surface 13, wherein the bores 25 are each arranged to receive an illumination bulb 26. It should be noted that a lace framework 24 is adhered or mechanically secured to the continuous side wall 15, as the lace framework is formed of a flexible material to accommodate mounting continuously about the side wall, as illustrated.

The bottom surface 14 includes batteries 28 mounted to the bottom surface along with a switch 29, with electrical conductive wires 27 in electrical communication between the batteries, switch, and each of the illumination bulbs 26 mounted within the bores 25, with each of the bulbs positioned adjacent to or projecting exteriorly of the top surface 13.

As desired, the side wall includes a top surface 30 arranged to receive a spirit level 31 utilizing fasteners 32 directed through the spirit level and received within the side wall top surface 30 to enhance ease of alignment and mounting of the assembled artwork 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A woodburning picture method, comprising the steps of:

providing a base plate, the base plate including a top surface spaced from a bottom surface, and a continuous side wall extending coextensively between the top wall and the bottom surface, and providing a writing instrument, and manually directing the writing instrument about the top surface to impart a picture outline on the top surface, and providing a woodburning tool, and manually directing the woodburning tool to superimpose the woodburning tool along and coextensive with the picture outline to burningly direct inscribed lines coextensively with the picture outline, and providing a paint brush, and directing the paint brush within the inscribed lines and exteriorly of the inscribed lines on the top surface to impart variously colored panels within the inscribed lines and exteriorly of the inscribed lines to completely direct a painted surface coextensively with the top surface of the base plate, and a flexible lace fabric framework is secured continuously to the side wall, and the step of directing communicating bores coextensively between the top surface and the bottom surface, and positioning an illumination bulb within each of said communicating bores, each illumination bulb is positioned adjacent the top surface, and directing electrically conductive wires in electrical communication with each illumination bulb and directing the conductive wires through the bores and mounted to the bottom surface of the base plate, and providing batteries and positioning the batteries fixedly to the bottom surface and positioning a switch in electrical communication between the batteries and the illumination bulbs to permit selective illumination of the illumination bulbs, and providing a spirit level, and wherein the continuous side wall includes a side wall top surface and positioning the spirit level on the top surface and directing fasteners through the spirit level and securing the spirit level to the side wall top surface.

* * * * *